US006491164B1

(12) United States Patent
Virvo

(10) Patent No.: US 6,491,164 B1
(45) **Date of Patent: *Dec. 10, 2002**

(54) FOLDABLE CONTAINER HAVING FLAT PROFILE

(76) Inventor: Alexander Virvo, 33 Glen Ter., Stamford, CT (US) 06906

( * ) Notice: Subject to any disclaimer, the term of this patent is extended or adjusted under 35 U.S.C. 154(b) by 0 days.

This patent is subject to a terminal disclaimer.

(21) Appl. No.: 09/714,570

(22) Filed: Nov. 16, 2000

Related U.S. Application Data

(63) Continuation-in-part of application No. 09/411,720, filed on Oct. 1, 1999, and a continuation-in-part of application No. 09/387,959, filed on Sep. 1, 1999, now abandoned.

(51) Int. Cl.[7] ..... B65D 85/00

(52) U.S. Cl. ..... 206/459.5; 206/736; 206/778; 40/604

(58) Field of Search ..... 206/232, 459.5, 206/457, 6.1, 736, 778, 767; D11/181, 182; 220/4.21, 4.24, 4.25; 40/603, 604; 229/120.011, 120.03

(56) References Cited

U.S. PATENT DOCUMENTS 1,486,695 A 3/1924 Singer et al.
1,988,280 A 1/1935 Levkoff
3,028,070 A * 4/1962 Schnur et al. ..... 206/459.5
4,228,945 A * 10/1980 Wysocki ..... 206/557
4,485,926 A * 12/1984 Lenzmeier ..... 229/120.011
5,071,000 A * 12/1991 Stewart ..... 206/6.1
5,458,235 A 10/1995 Stone

* cited by examiner

*Primary Examiner*—Shian Luong
(74) *Attorney, Agent, or Firm*—Grimes & Battersby, LLP

(57) ABSTRACT

A container is provided having at least two separate container elements attached by means of a flexible banner bearing a message or artwork. Each of the containers has an opening in the top thereof for storage and transportation of a variety of goods. The flexible banner is attached to each container element at one edge thereof such that the edges of attachment are adjacent to each other when the container is in the closed position. The container elements are adapted to fit adjacent to each other to form a large container, this large container being bordered on all sides by the flexible banner when in the closed position. When the container elements are rotated in opposite directions relative to each other, a message imprinted on the inner surface of the flexible banner is made visible. Alternatively, the container elements may be permanently sealed for display of such unique items such as liquid sculptures or other artwork. The container may be folded to have a substantially flat profile for storage, transportation, distribution and/or display.

11 Claims, 11 Drawing Sheets

FOLDABLE CONTAINER HAVING FLAT PROFILE

RELATED APPLICATION

This is a continuation in part of U.S. patent application Ser. No. 09/387,959 filed on Sep. 1, 1999 now abandoned, and Ser. No. 09/411,720 filed on Oct. 1, 1999, both in the name of Alexander Virvo for Container With Message.

BACKGROUND OF THE INVENTION

1. Field of the Invention

The present invention relates generally to a container, and more particularly, to a container having two separate container elements attached by means of a flexible sheet or paper having a graphic image imprinted thereon, such that the two separate container elements are separated by the banner. Each of said container elements has an opening in the top thereof for storage and transportation of a variety of goods. The flexible sheet or paper is attached to each container at one edge thereof, such that the edges of attachment are adjacent to each other when the container is in a closed position. Alternatively, the container elements may be permanently sealed for display of such unique items such as liquid sculptures or other artwork. The container may be formed from a single flexible sheet or paper, and one or more clear acetate windows may be disposed thereon for displaying the goods.

2. Description of the Prior Art

Containers and other means for storing and transporting goods have been known since ancient times. The use of such containers to display messages has similarly been known for many years. Such messages, however, have typically been limited to messages imprinted on a label or tab that is affixed to the container or storage means.

For example, U.S. Pat. No. 4,304,328 which issued to Pilat on Dec. 8, 1981 for Receptacle Storage Package Having Oblique Surfaces, discloses a receptacle storage package having oblique base surfaces converging so as to tilt the receptacles towards one another. The receptacles would contact each other, in storage, but for the placement of a receptacle restraining piece positioned between the upper surfaces of the receptacles, which restraining pieces bears a message.

Furthermore, the use of packaging having information imprinted thereon is well known. For example, U.S. Pat. No. 3,918,631, which issued to Hackenberg on Nov. 11, 1975 for Decorator Box, discloses a box formed from a single blank having four sides and top and bottom covers. The outer wall carries advertising and descriptive material and the inner wall is decorated with a design. Similarly, U.S. Pat. No. 4,964,513 which issued to Ingram, et al. on Oct. 23, 1990 for Package, discloses a cartonless recyclable package for protectively enclosing a product, such as photographic film, comprising a recyclable plastic container and mating cap with recyclably compatible plastic labels thereon bearing product information. An outer sheet can be peeled back to reveal information on the interfacing surfaces of both sheets, and then re-adhered to the inner sheet. A label may be peeled away and re-adhered to some other surface for reference after the product has been removed. A thumb tab on the cap, to facilitate cap removal, is used also to orient the container and cap for appropriate placement of the labels, and to orient the resulting package in a cooperating displaying and dispensing device. In addition, U.S. Pat. No. 5,022,526 which issued to Crum on Jun. 11, 1991 for Label-Containing Package Assembly, discloses a compact piggyback expandable package assembly for dispensing labels for attachment to bottles, containers, and closure caps, as well as to other surfaces. The package assembly is used primarily in the pharmaceutical industry. The package assembly comprises a special foldable package which encloses a set of labels. A resealable tab can be provided to facilitate opening and closing of the package. In the preferred form, the piggyback package assembly has a base or base label which is attached to the package. The underside of the base has adhesive portions so that the package assembly can be mounted upon the top surface of a closure cap of a bottle, a web, or some other surface.

Novelty containers bearing messages are also well known in the industry. For example, U.S. Pat. No. 4,171,085 which issued to Doty on Oct. 16, 1979 for Tear Tab Disposable Cup or Container Structure, discloses a paper or plastic cup or container having a pull-tab extending from the side seam which can be torn off by the consumer to be used as a coupon, proof-of-purchase or to reveal some form of concealed marking which might entitle the consumer to a premium, gift or other consideration. The pull-tab is perforated to maintain the integrity of the container and preventing leakage or spill of the contents.

Message bearing banners may also be used in emergency situations. For example, U.S. Pat. No. 5,893,226 which issued to Sophocleous, et al. on Apr. 13, 1999 for Assistance Summoning Device, discloses a banner-like device made of a light weight, flexible, and foldable sheet of material that is temporarily attachable to vehicles such as cars, trucks, motorcycles, boats, campers, and aircraft. The device includes at least two support rods to maintain the banner in an unfurled position.

In the photographic field, U.S. Pat. No. 4,966,285 which issued to Otake, et al. on Oct. 30, 1990 for Container Having Index Sheet and Recording Medium discloses an index sheet formed of one recording sheet on which are printed a plurality of scenes recorded on an image recording medium such as, for example, a photographic film, a still video floppy, a video cassette, or a video disc. The images are arranged in the same order they were taken, and frame numbers are printed in juxtaposition with the respective positive images. This index sheet can be part of a package comprising a container having a casing formed with at least one recess for the image recording medium and/or printed photographs, and a cover swingably mounted on the casing. A transparent pocket formed on the outer or inner side of the cover contains the index sheet.

A recent trend in the commercialization of packaging and containers is that more and more packaging, instead of being an after purchase activity, is being made part of the initial purchasing decision by being brought out and displayed near the purchase items. For example many music stores will display specially themed flat packaging designed to hold CD's, cassette's, DVD's, and video's with the product, giving consumers a reason to give the gift of a movie or music. Candy stores are large users of specialty containers and will display specialty packaging including: cute bags; special boxes, molded plastic containers and dispensers, often themed with celebratory messages such as "Happy Birthday," good wishes, "I love you," etc.

Since retail space is often at a premium, merchants and marketers are constantly on the lookout for packaging that folds and or displays flat. An example of this are decorated party goodie bags, which are packaged flat, sold in sets of 6, 8, or 10 in a package, and are displayed on racks or on peg hooks. The themed packaging for CD's, cassette's, DVD's and video's is yet another example of flat packaging that merchants and marketers offer in racks.

Furthermore, many of the packaging systems in use today are elaborate dimensional packages produced by hand, or with little automation, taking time and money to produce. Dimensional packaging produced from materials other than paper also take up more space and are expensive to produce.

However, there are no devices or methods which disclose the use of separate container elements flexibly attached to opposite edges of a message-bearing banner. Furthermore, there are no such packaging systems or containers that may be folded to a substantially flat profile, thereby reducing the space required for the storage and/or transportation of such packaging systems. The prior art containers fail to offer the unique advantages contemplated by the present invention.

SUMMARY OF THE INVENTION

Against the foregoing background, it is a primary object of the present invention to provide a container with banner having at least two separate container elements flexibly attached to a sheet or paper banner bearing a message.

It is another object of the present invention to provide such a container wherein said container elements and banner are formed from a single flexible sheet or paper.

It is another object of the present invention to provide such a container that is inexpensive to manufacture.

It is another object of the present invention to provide such a container that allows for the transportation of at least two separate goods.

It is still another object of the present invention to provide such a container that allows for the storage of at least two goods in two separate and independent chambers.

It is but another object of the present invention to provide such a container that allows for the display of the goods contained therein.

It is another object of the present invention to provide such a container that forms a totally enclosed container in the closed position.

It is still another object of the present invention to provide such a container that reveals a message when the separate container elements are rotated in opposite directions relative to each other.

It is but another object of the present invention to provide such a container that may be folded so as to save space.

It is yet another object of the present invention to provide such a container that may be folded into a substantially flat profile.

It is still another object of the present invention to provide such a container that may be produced with standard packaging machinery, at high speeds.

To accomplish the foregoing objects and advantages, the present invention, in brief summary, comprises a container having at least two separate container elements flexibly attached to opposite edges of a banner. Said container elements and banner may be formed from a single flexible sheet or paper, or alternatively, formed from separate materials. Each of the containers has an opening in the top thereof for storage and transportation of a variety of goods. The banner is attached to each container element at one edge thereof by means of a flexible hinge such that the container elements are adjacent to each other when the container is in the closed position. The container elements are adapted to fit adjacent to each other to form a large container, this large container being bordered at least one side by the banner when the large container is in the closed position. The container has a closed position and an open position. When the container elements are rotated from the closed position in opposite directions relative to each other to the open position, a message imprinted on the inner surface of the flexible banner, which message is partially or completely hidden in the closed position, is made visible.

The container may be stored in a substantially flat, folded state, yet can be easily constructed into a package, that forms what seems to be a single container. Since the container can be stored and displayed flat, it requires minimal space for storage and display, thus allowing for large amounts of inventory in a very small space.

In addition, the banner may comprise a connecting structure. A message or product may be affixed to or held by the connecting structure. The container elements may be flaps if the banner comprises a a connecting structure capable of holding an object, such as a video.

The container elements may be deliberately designed to only partially cover the connecting structure in a closed position, which will create a gap that may accommodate other items between the container elements when the container is in the closed position. The container may store anything that can fit into the two container elements, and, if desired, can accommodate additional items in the gap between the container elements. Finally the container may be finished by sliding a belly band over the container when it is in the closed position or by using another acceptable closure mechanism, thus eliminating the time consuming activity of gift wrapping.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

BRIEF DESCRIPTION OF THE PREFERRED EMBODIMENTS

Figure 1:
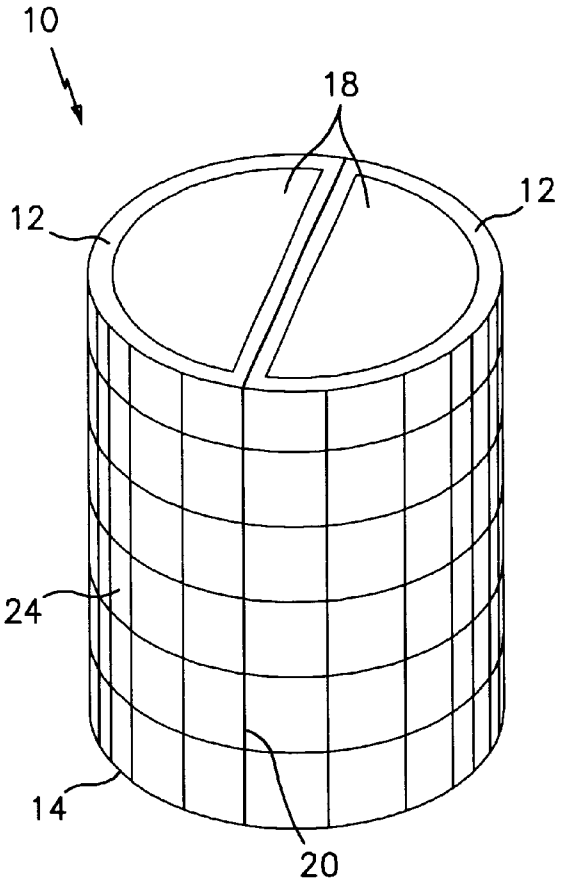
FIG. 1 is a perspective illustration of the container of the present invention in the closed position.

Referring to the drawings and, in particular, to FIG. 1 thereof, the container of the present invention is provided and is referred to generally by reference numeral 10. The container 10 includes at least two separate container elements 12 attached by means of a flexible sheet or paper banner 14, which banner bears a message or graphic image 16. The banner 14 extends around the entire surface of the container 10 in the closed position, which position is illustrated in FIG. 1.

The container elements 12 and banner 14 bearing message 16 may all be formed from a single flexible sheet or paper, or, alternatively, from separate materials. The use of the single flexible sheet in constructions serves to facilitate the manufacture and construction of the container 10, as well as significantly reduce the costs associated with production. Furthermore, container elements 12 need not be containers at all, but could also include complementary dolls or figures, plush animals, toys or sculptural artwork.

Each container element 12 is enclosed on all sides but for an opening 18 in the top thereof, said opening 18 being adapted to accept a variety of goods such as jelly beans, popcorn, etc. Obviously, the larger the container 10, the larger the goods, such as toys or novelty items, that will fit within each container element 12. Conversely, smaller containers 10 having small container elements 12 may be used for the storage and transportation of smaller items such as beads and the like.

The container 10 may come in any shape, although in the preferred embodiment the container 10 is may be rectangular or cylindrical, and each of the container elements 12 is either shaped as a half circular cylinder or rectangular cylinder. For obvious reasons, the rectangular shape is easier to manufacture. If the banner 14 extends around the entire surface of the container 10 in the closed position, the length of the banner 14 will be equal to the circumference of the cylindrical container 10 or the perimeter of the rectangular container 10. Alternatively, if the banner 14 need only cover one side of each container element 12, in which case the length of the banner 14 will be at least as long as the combined length of the side of each container element 12. However, it should be appreciated that the container 10 may also come in a variety of other shapes such as a square, triangle or pentagon. In such embodiments, the length of the banner 14 will be at least as long as the perimeter of such other shape or at least as long as the combined length of the sides of each element 12.

The banner 14 is attached to each container elements 12 at one edge 20 thereof by means of a flexible hinge. Various means of affixation exist, such as magnetic means, clasps, clamps clips, snaps, hook and loop means or molded fixtures such as snap fits or press fits.

The container elements 12 are adapted to fit adjacent to each other in the closed position to form the larger container 10. In the preferred embodiment, each container element includes a planar surface 22 of substantially the same size and shape, which planar surfaces 22 are adapted to fit adjacent to each other in the closed position. However, it should be appreciated that the surface 22 of the container elements 12 may be of any other configuration, provided that the adjacent surfaces 22 of each container element 12 are complementary to each other.

The banner 14 is attached to the opposite edges 20 of the container elements 12 such that, when the container 10 is in the closed position (reference FIG. 1), the edges 20 are adjacent to each other. When the container 10 is in the closed position, only the outer surface 24 of the banner 14 is visible. The outer surface 24 may contain a design or message appropriate for the goods contained within the container elements 12. For example, if the container 10 is used to convey a birthday wish, the outer surface 24 may contain artwork or a message, while the inner surface 26 may also contain artwork, or a birthday wish or message or even a personalized message. Alternatively, if the container 10 is used to store and transport candy, the outer surface 24 may contain the product name and nutritional information.

Figure 2:
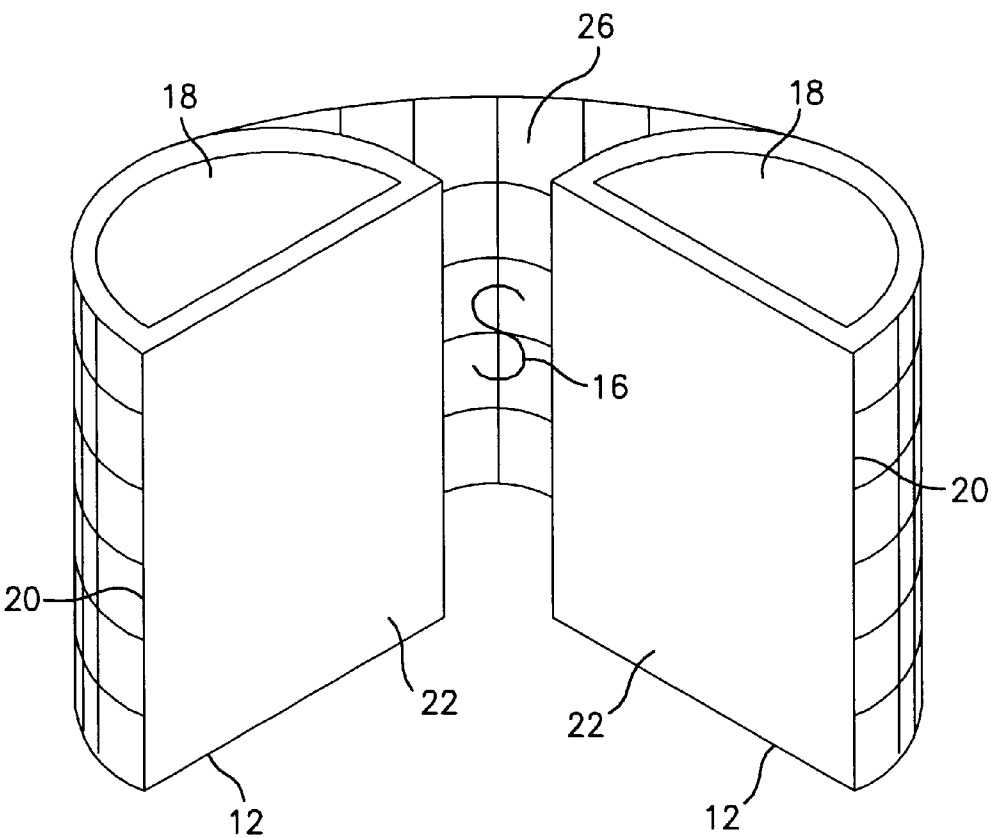
FIG. 2 is a perspective illustration of the container of the present invention in an intermediary state between the closed and open position.
Figure 3:
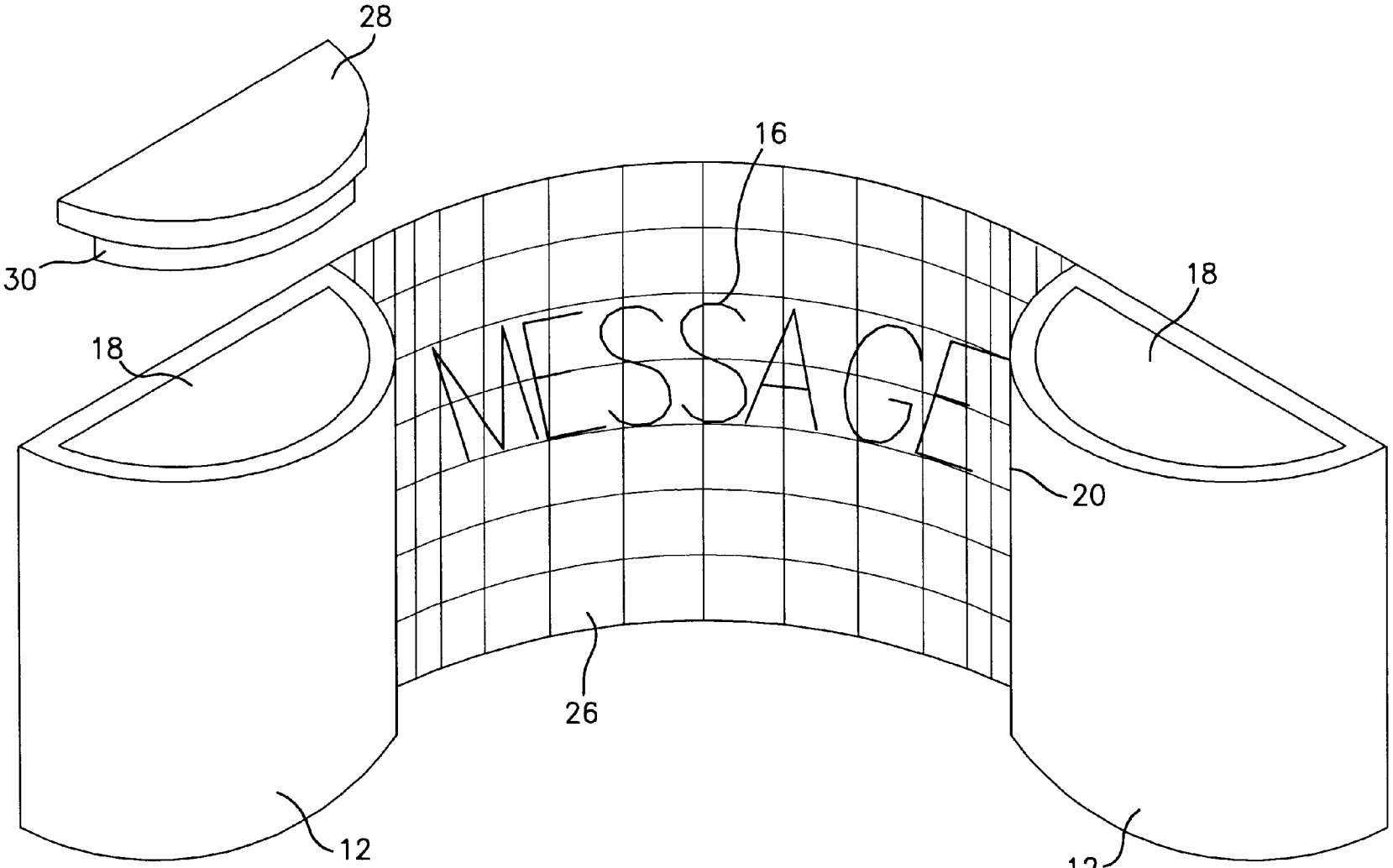
FIG. 3 is a perspective illustration of the container of the present invention in the open position.

In the closed position (reference FIG. 1), the banner 14 serves to retain the separate container elements 12 in such closed position. When container elements 12 are rotated in opposite directions relative to each other, the message or artwork 16 imprinted upon the inner surface 26 of the banner is revealed (as shown in FIGS. 2 and 3), which may contain artwork, a message or even a personalized message.

Container tops 28 may also be provided to prevent spillage of the contents of the container elements 12. Container tops 28 may be larger than the opening 18 of the container element 12 so as to allow container tops 28 to sit on the top of container element 12. Container tops 28 include a lip 30 adapted to fit within the opening 18 of container elements 12, said lip 30 being of a size slightly smaller than the opening 18, keeping container top 28 in position by means of a friction fit. It should be appreciated that alternative means for affixing said top 28 to said container element 12 exist, such as hinge means, locks, snaps or straps. However, container tops 28 are not required to retain the integrity of the design.

Figure 4A:
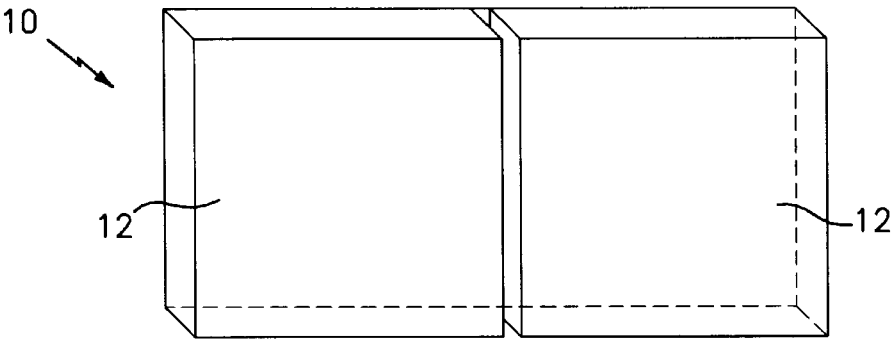
FIG. 4A is a perspective illustration of the container of the present invention in the closed position.
Figure 4B:
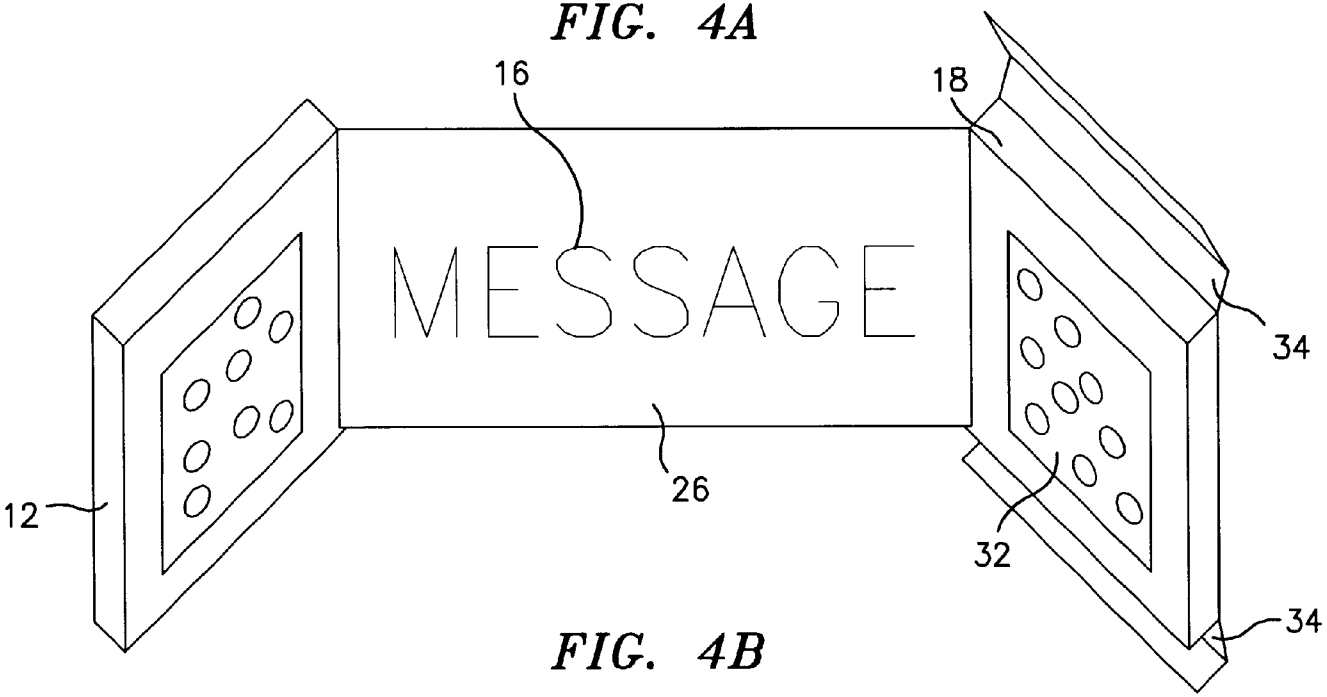
FIG. 4B is a perspective illustration of the container of the present invention in the opened position.

FIGS. 4A and 4B illustrate another embodiment of the present invention. In FIG. 4A, the container 10 is illustrated in the closed position, with the container elements 12 adjacent to each other and the banner 26 adjacent thereto. As shown in FIGS. 4A and 4B, the banner 26 does not extend around the entire container 10, but merely covers one side of each container element 12. It should be appreciated, however, that the banner 26 may also extend around the entire container 10 so as to cover every external surface thereof. FIG. 4B shows the container 10 after the container elements 12 have been rotated relative to each other to display the message 16 imprinted on the banner 26.

Container elements 12 include a window 32 on an inner surface thereof so as to display the contents of the container elements 12. In the preferred embodiment, the window 32 is composed of a clear plastic or acetate, although any other transparent medium (or no medium at all) may be utilized. The window 32 is affixed to the opening in the container element 12 by means of an adhesive or other affixation means such that the window 32 will be stationary during transportation and storage of goods contained within container elements 12.

The openings 18 at the tops and bottoms of the container elements 12 are closed by means of flaps 34 formed from the flexible sheet or paper of the banner 26. Flaps 34 may be opened and closed so as to allow for insertion and removal of objects from the container elements 12. In the preferred embodiment, simple box-top type flaps 34 are used, which flaps 34 serve adequately to retain any items stored in container elements 12. However, other means of securing the openings 18 by means of flaps 34 exist, such as with releasable adhesives, snaps, buttons or hook and loop materials.

For transportation purposes, the separate container elements 12 of container 10 may be secured by means of an adhesive such as tape or a strap (not shown), which adhesive would prevent the container elements 12 from separating during transport. Alternatively, the banner 26 may include an extended flap that can be used to wrap around the entire container 10 when in the closed position. Of course, other means for securing the container 10 during transportation exist, such as a sleeve or retaining strap (belly band) for inserting the entire container 10, or a separate box.

Figure 5A:
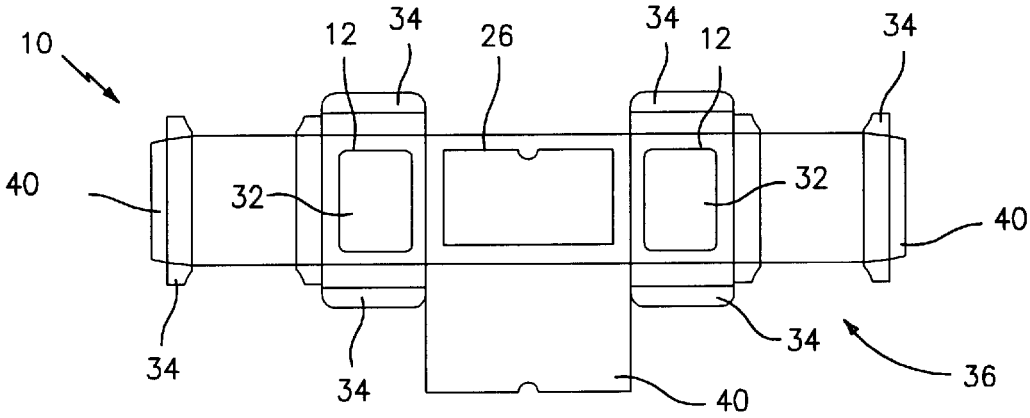
FIG. 5A is a front elevational view of the container of the present invention in a completely unfolded, flat state.
Figure 5B:
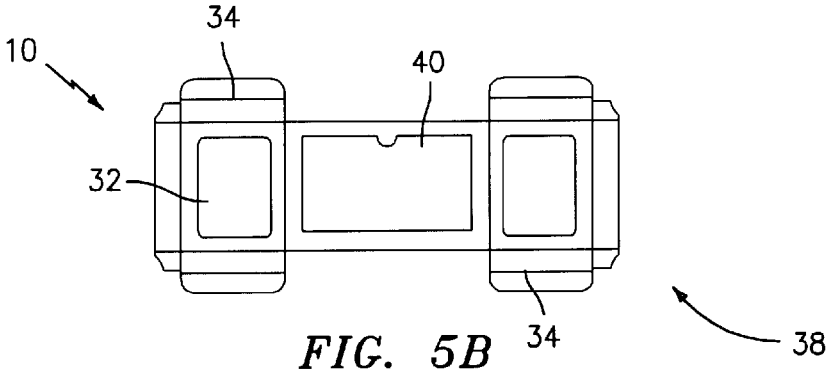
FIG. 5B is a front elevational view of the container of the present invention in a partially assembled, flat state.
Figure 5C:
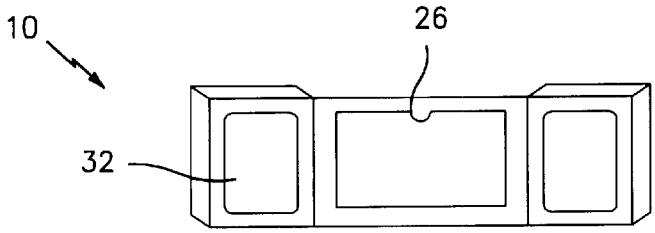
FIG. 5C is a front elevational view of the container element of the present invention in a n assembled, open state.
Figure 5D:
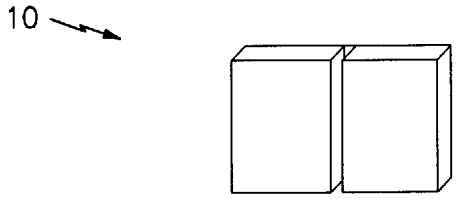
FIG. 5D is a front elevational view of the container element of the present invention in an assembled, closed state.
Figure 5E:
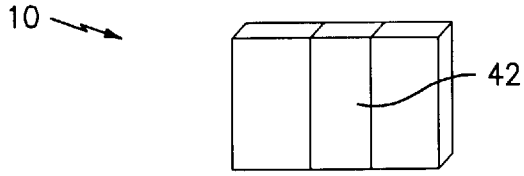
FIG. 5E is a front elevational view of the container element of the present invention in an assembled, closed state with a retaining strap surrounding the container and retaining it in the closed state.

Illustrated in FIGS. 5A through 5E is the manner in which the container 10 of the present invention may be stored in an unassembled state such that the container 10 has a relatively flat profile (as shown in FIG. 5A), then assembled into the three-dimensional container 10 (as shown in FIGS. 5C through 5E). As previously discussed, the benefits of being able to store the container 10 in an unassembled, flat state 36 are numerous, foremost of which are the space saving benefits, and the reduced manufacturing costs. Alternatively, the container 10 may be stored in a partially assembled state 38, which state is still relatively flat, but requires less work by an individual in assembling the three-dimensional container 10. The primary difference between the unassembled state 36 and the partially assembled state 38 is that adhesive has already been applied to the tabs 40, which tabs are then attached to their respective container elements 12 so as to form the three-dimensional container elements 12, which may be folded in a flat state (as shown in FIG. 5B).

In all other respects, the unassembled container 36 is identical to the container 10 in the assembled state, including the banner 26, flaps 34 and optional windows 32. Another element that may be present is an extension flap 40, which flap 40 may cover the banner 26 or contain additional information, such as coupons and the like. In addition, a strap 42 may be included to serve to retain the container elements 12 in the closed position.

Figure 6A:
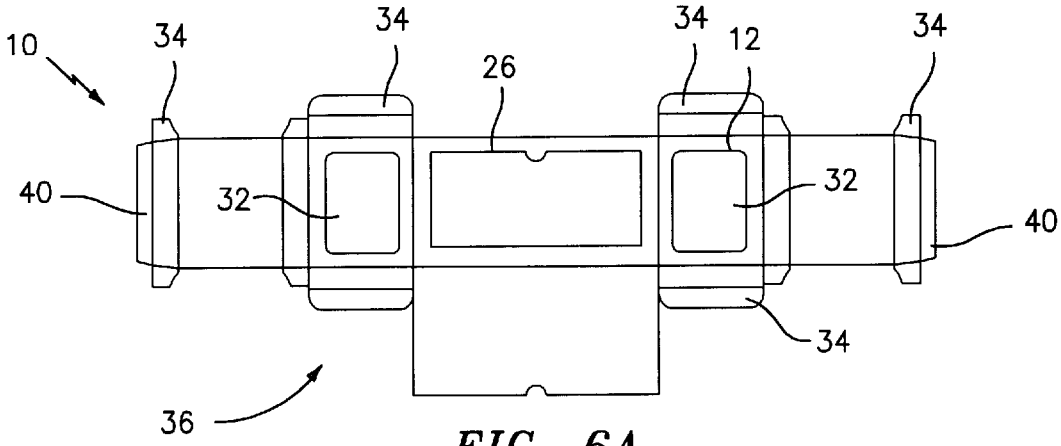
FIG. 6A is a front elevational view of an alternate embodiment of the container of the present invention having a space between container elements in a completely unfolded, flat state.
Figure 6B:
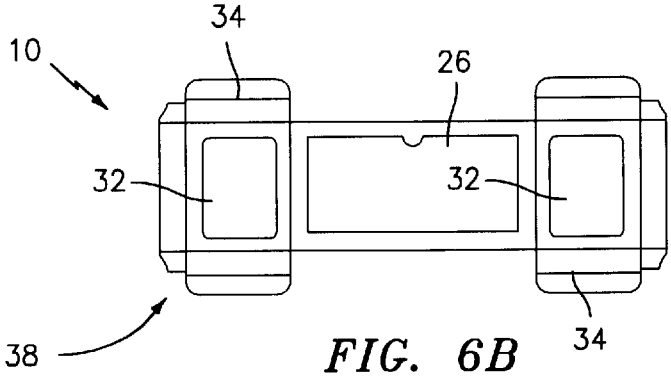
FIG. 6B is a front elevational view of the container of FIG. 6A in a partially assembled, flat state.
Figure 6C:
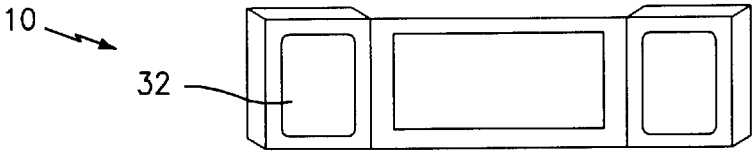
FIG. 6C is a front elevational view of the container of FIG. 6A in an assembled, open state.
Figure 6D:
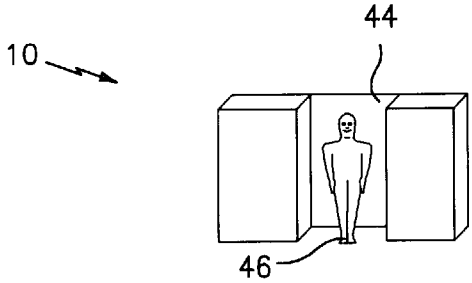
FIG. 6D is a front elevational view of the container of FIG. 6A in an assembled, closed state with a novelty item placed in the gap between the container elements.
Figure 6E:
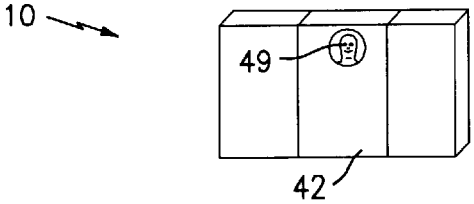
FIG. 6E is a front elevational view of the container of FIG. 6A in an assembled, closed state with a band retaining the container in the closed position, retaining the novelty item in the gap between the container elements, and a window allowing for partial viewing of the novelty item.

An alternate embodiment of the container 10 that may be folded in a flat profile is shown in FIGS. 6A through 6E. In said embodiment, the banner 26 is longer than the combined width of the container elements 10, thereby creating a gap 44 between the container elements 12 when the container 10 is in the closed position (as shown in FIG. 6D). Said gap 44 is designed to be an additional storage space, wherein promotional materials 46 may be placed so as to completely or partially block the message or artwork 16 on the banner 26. An aperture 49 may be included in the optional strap 42 to allow an individual to see a portion of said promotional materials 46 when said strap 42 is in place (as shown in FIG. 6E).

Figure 7A:
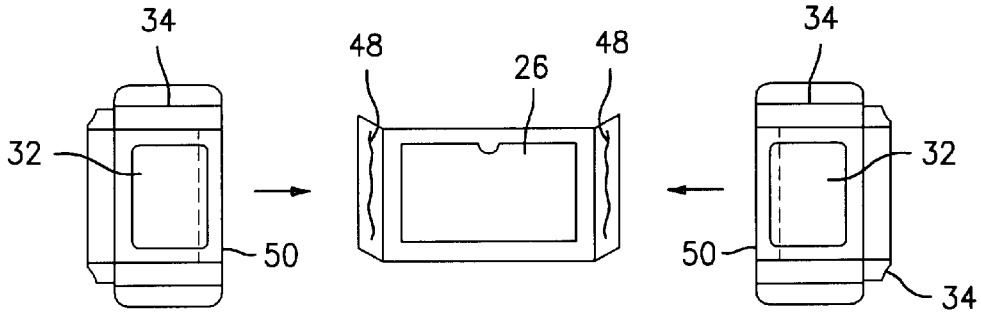
FIG. 7A is a front elevational view of an alternate embodiment of the container of the present invention in which the container elements are separated from the banner.
Figure 7B:
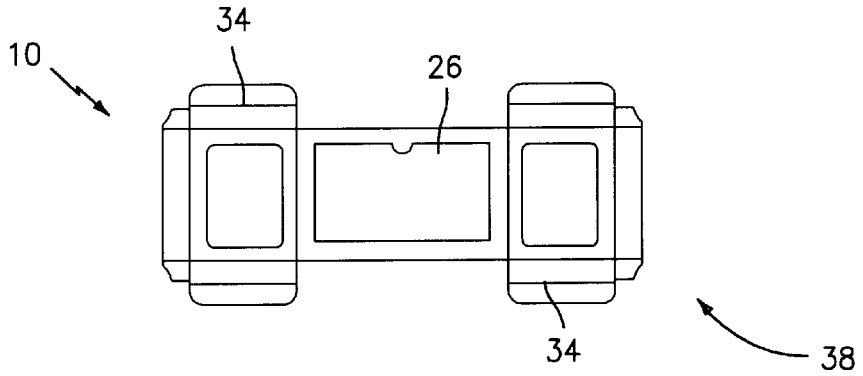
FIG. 7B is a front elevational view of the container of FIG. 7A in which the container elements have been attached to the banner.
Figure 8A:
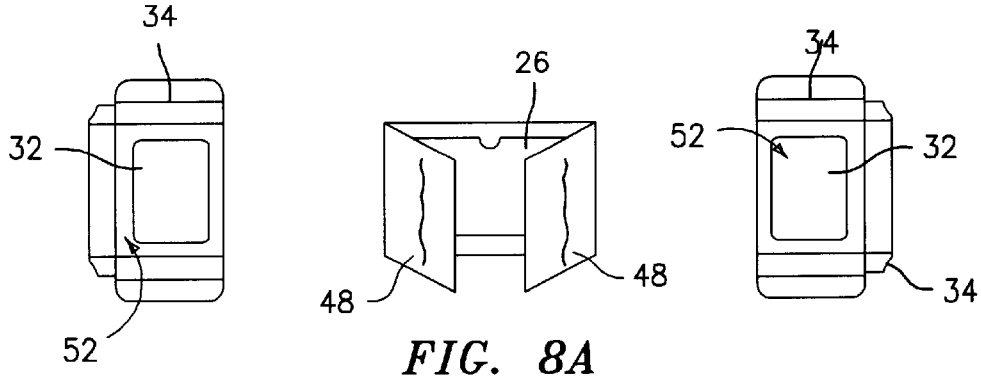
FIG. 8A is a front elevational view of an another alternate embodiment of the container of the present invention in which the container elements are separated from the banner.
Figure 8B:
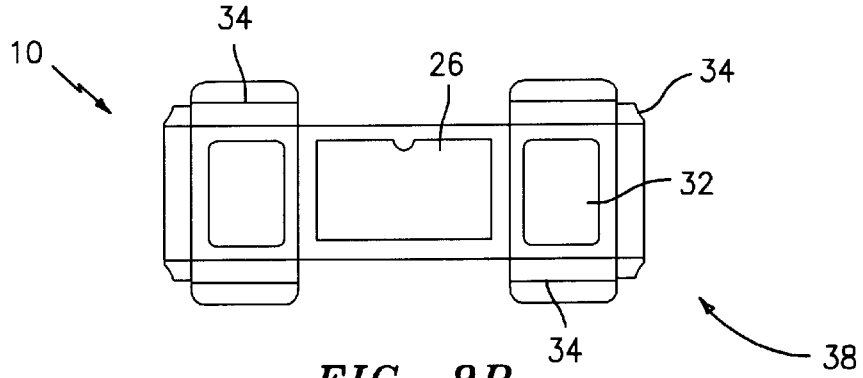
FIG. 8B is a front elevational view of the container of FIG. 8A in which the container elements have been attached to the banner.

Illustrated in FIGS. 7A and 7B, and in FIGS. 8A and 8B are an alternate embodiment of the container 10 wherein the container elements 12 are separated from the banner 26. Such embodiment allows for the purchaser to select from among a variety of different container elements 12 and banners 26 so as to create a more personalized container 10. The separated container elements 12 are attached to the banner 26, preferably by means of an adhesive applied to banner tabs 48, which banner tabs 48 may then be attached to the individual container elements 12. The banner tabs 48 in FIG. 7A are designed to attach to the side panels 50 of the container elements 12, while the banner tabs in FIG. 8A are designed to attach to the back 52 of the individual container elements 12.

Figure 9A:
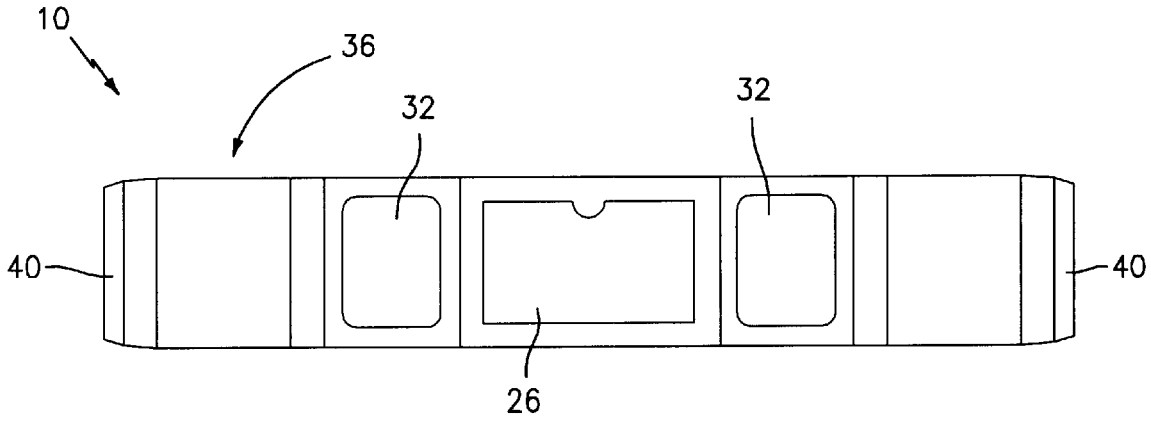
FIG. 9A is a front elevational view of an alternate embodiment of the container of the present invention in a completely unfolded, flat state.
Figure 9B:
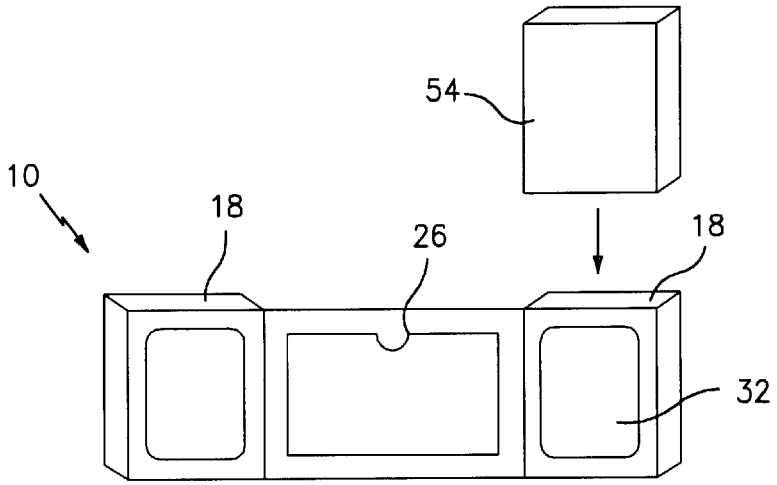
FIG. 9B is a front elevational view of the container of FIG. 9A in an assembled, open state.

In another embodiment, as shown in FIGS. 9A and 9B, the closure flaps 34 may be eliminated entirely, thereby leaving the openings 18 at the top and bottom of the container elements. The stored object 54 may then be slid into the container elements 12 through the openings 18, and retained therein by friction or other means, such as an adhesive or a strap. Alternatively, flaps 34 may be included only on the bottom, or only on the top, of the container elements 12, thereby acting as a restraint to prevent the stored object 54 from sliding out. Said embodiment has particular utility when the stored object 54 is rectangular in shape, such as a video tape or a book.

Figure 10:
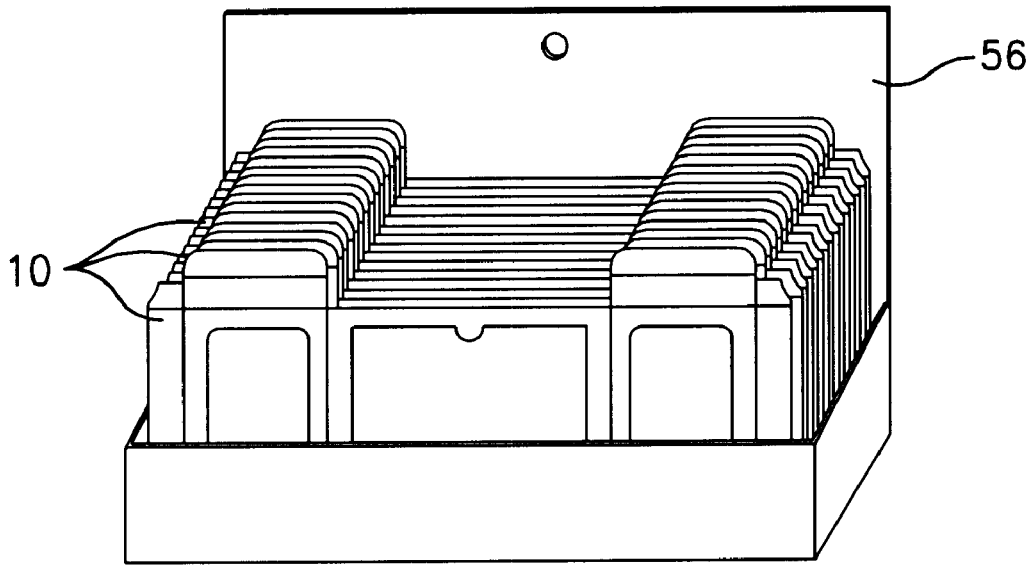
FIG. 10 is a perspective illustration showing the containers of the present invention being displayed in a flat state.
Figure 11:
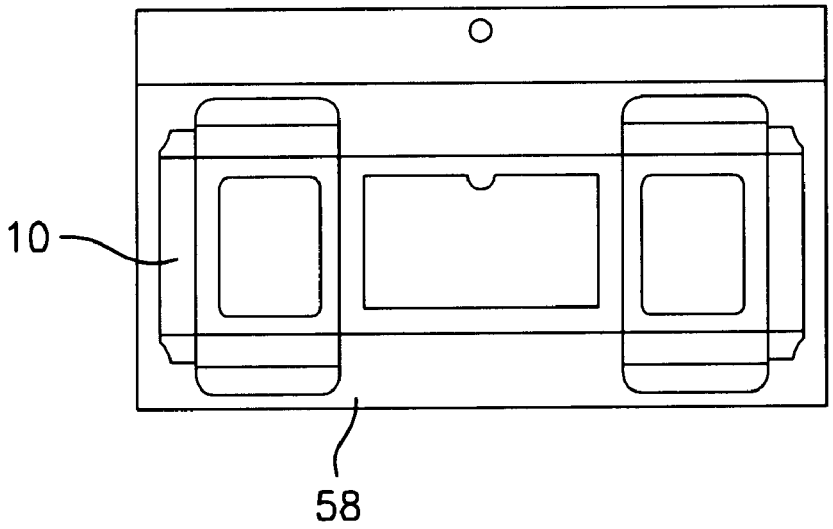
FIG. 11 is a front elevational view of the container of the present invention being packaged in the folded state.
Figure 12A:
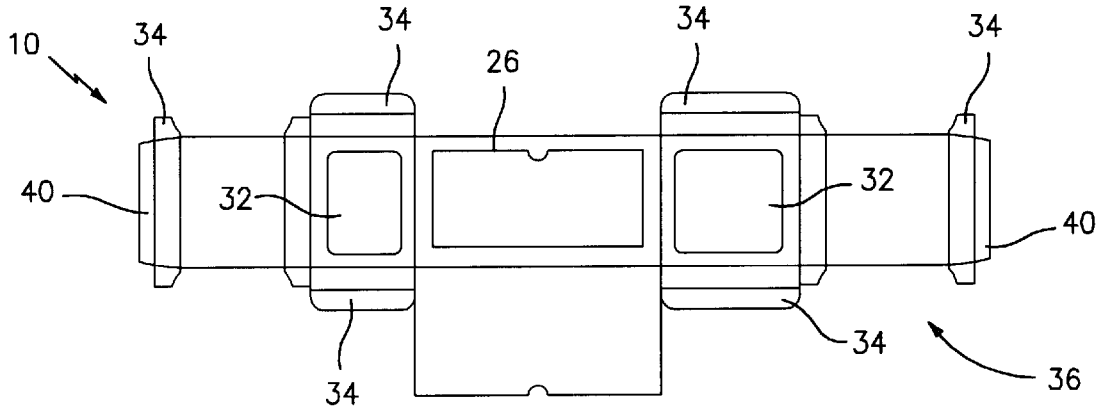
FIG. 12A is a front elevational view of yet another alternate embodiment of the container of the present invention in a completely unfolded, flat state.
Figure 12B:
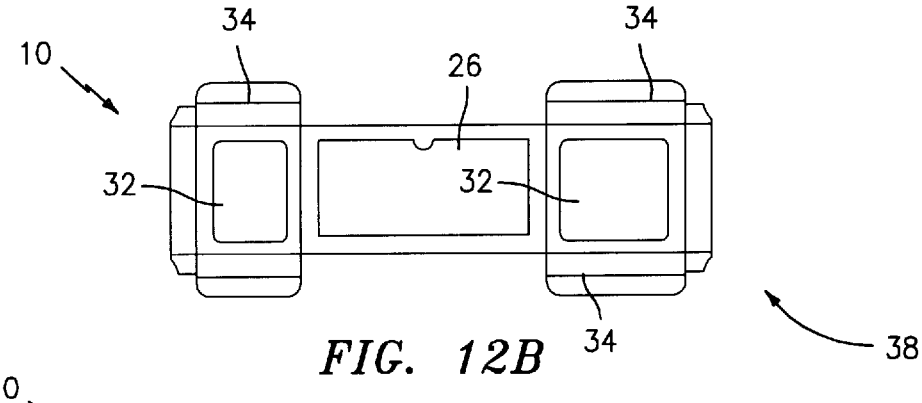
FIG. 12B is a front elevational view of the container of FIG. 12A in a partially assembled, flat state.
Figure 12C:
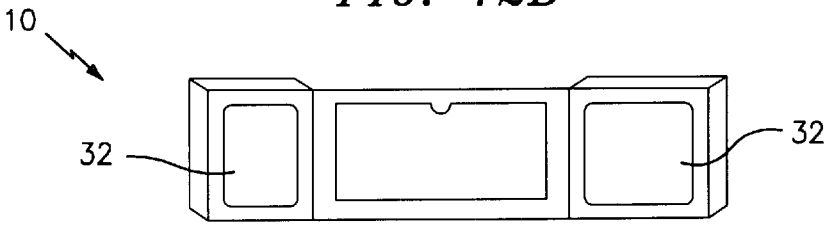
FIG. 12C is a front elevational view of the container of FIG. 12A in an assembled, open state.
Figure 12D:
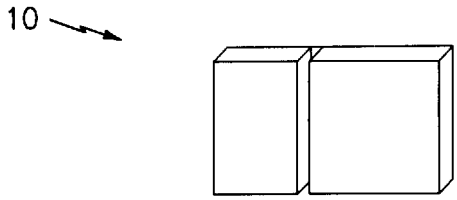
FIG. 12D is a front elevational view of the container of FIG. 12A in an assembled, closed state.
Figure 12E:
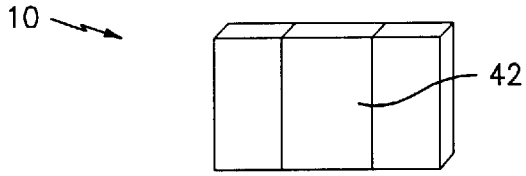
FIG. 12E is a front elevational view of the container of FIG. 12A in an assembled, closed state with a retaining strap retaining the container in the closed position.
Figure 13A:
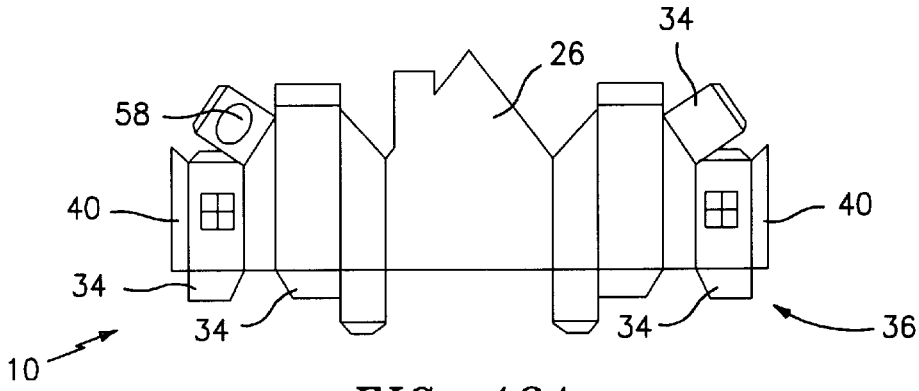
FIG. 13A is a front elevational view of yet still another alternate embodiment of the container of the present invention in the shape of a house in a completely unfolded, flat state.
Figure 13B:
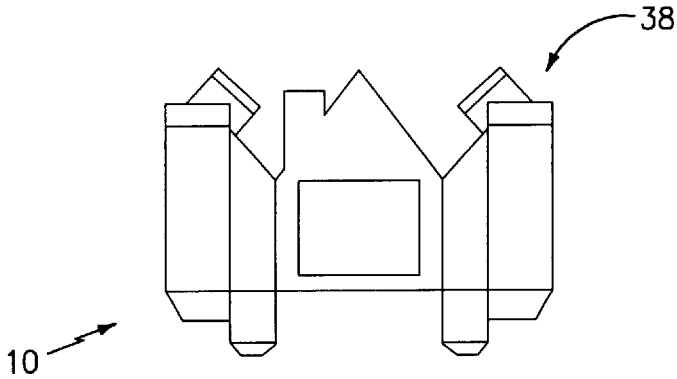
FIG. 13B is a front elevational view of the container of FIG. 13A in a partially assembled, flat state.
Figure 13C:
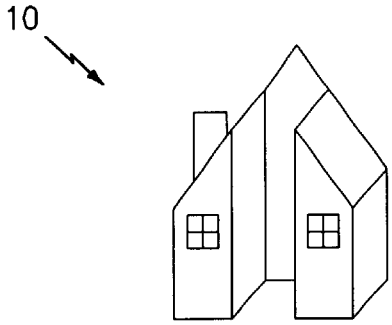
FIG. 13C is a front perspective view of the container of FIG. 13A in an assembled, closed position.
Figure 13D:
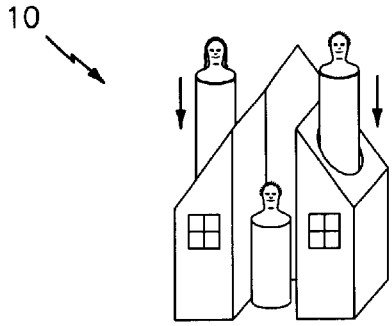
FIG. 13D is a front perspective view of the container of FIG. 13A in an assembled, closed state and having promotional materials stored therein and protruding therefrom.

The benefit of having the containers 10 being foldable into a substantially flat profile is shown in FIGS. 10 and 11, which demonstrate the retail applications of the folded containers 10. FIG. 10 shows a display case 56 in which a plurality of folded containers 10 are offered for sale or use by an individual to store candy, for example. FIG. 11 shows the folded container 10 being packaged in a transparent plastic bag or shrink-wrapped package, which package is ideally suited for retail sale.

It should be appreciated that the width of the container elements 12 need not be identical, although such is the case in the preferred embodiments. Illustrated in FIGS. 12A through 12E is a container in which one container element 12 is wider than the other. Although the embodiment in FIGS. 12A through 12E show the banner 26 being substantially the same length as the combined width of the container elements 12, it should be appreciated that the banner 26 could be longer than such combined width, thereby creating a gap 44.

While in the preferred embodiments illustrated in FIGS. 4A through 12E, the containers 10 and the container elements 12 are rectangular in shape, there is practically no limit to the size or shape that the container may come in. For example, illustrated in FIGS. 13A through 13D is a house-shaped container 10, wherein the banner 26 is in the shape of the house's profile, and each of the container elements 12 is a "room" of the house. A cutout 58 may be included in one or more of the flaps 34 to allow for the insertion and removal of the promotional materials 46.

Figure 14A:
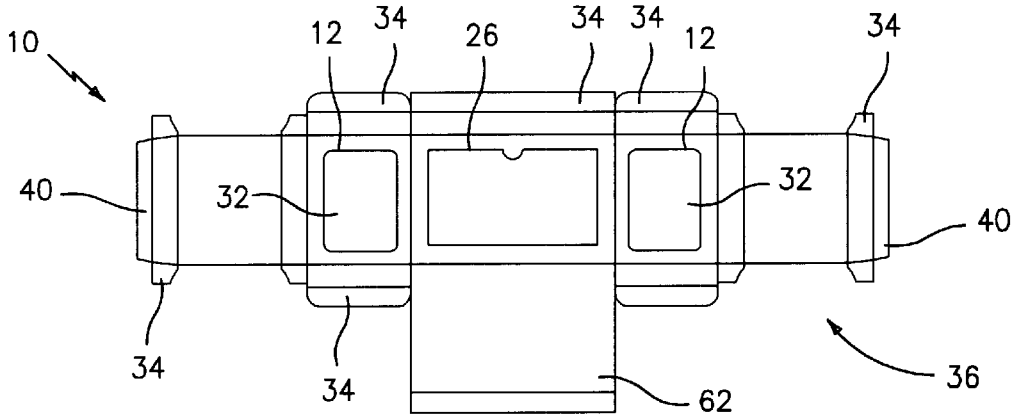
FIG. 14A is a front elevational view of but still another alternate embodiment of the container of the present invention in a completely unfolded, flat state.
Figure 14B:
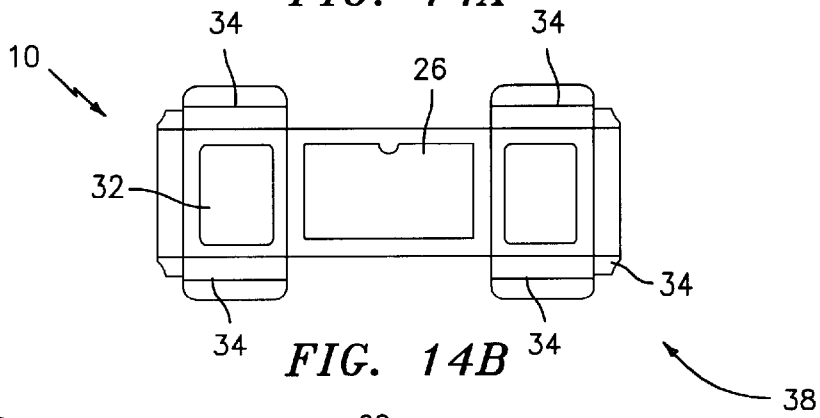
FIG. 14B is a front elevational view of the container of FIG. 14A in a partially assembled, flat state.
Figure 14C:
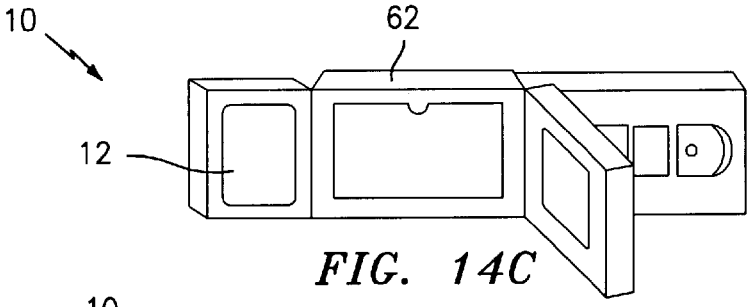
FIG. 14C is a front perspective view of the container of FIG. 14A in an assembled, open position.
Figure 14D:
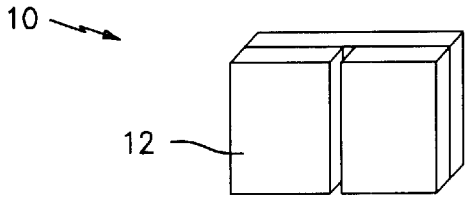
FIG. 14D is a front perspective view of the container of FIG. 14A in an assembled, closed state.
Figure 14E:
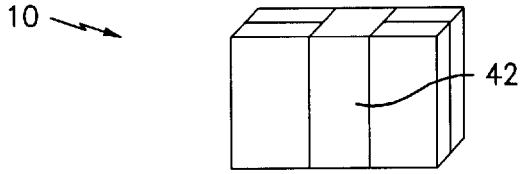
FIG. 14E is a front elevational view of the container of FIG. 14A in an assembled, closed state with a retaining strap retaining the container in the closed position.

Illustrated in FIGS. 14A through 14E is yet another alternate embodiment of the foldable container 10 including a center pocket 60 disposed behind the banner 26 thus forming a connecting structure. Said center pocket 60 is formed from the pocket flap 62 which extends from the banner 26, and is particularly suited for sliding rectangular objects such as videos and books therein. The container elements may be flaps (not shown) in this embodiment where the banner comprises a connecting structure. The flaps serve to alternatively hide and reveal the banner. The connecting structure serves as a container for the rectangular or other shaped objects. Illustrated in FIG. 14C is the video being inserted into the center pocket 60, and in FIG. 14D is shown the video fully inserted.

Having thus described the invention with particular reference to the preferred forms thereof, it will be obvious that various changes and modifications can be made therein without departing from the spirit and scope of the present invention as defined by the appended claims.

Wherefore, I claim:

1. A container for the distribution and display of promotional and novelty items, said container having an open and closed position and comprising:

at least two separate container elements adapted to receive and store said promotional and novelty items, said elements including at least one opening;

a banner having interior and exterior surfaces, wherein the length of said banner is at least as long as the combined width of said elements;

wherein said banner is connected to both of said at least two separate container elements by foldable joints such that the two container elements are permanently joined;

wherein said elements cover at least a portion of said interior surface when said container is in said closed position, and wherein said elements reveal said at least a portion of said interior surface when said container is in said open position;

wherein said container is adapted to be folded into a substantially flat profile when said container is in a partially assembled state;

wherein said banner comprises a first graphic image imprinted on said interior surface and a second graphic image imprinted on said exterior surface; and wherein said container elements further include flap closure means.

2. The container of claim 1, wherein said container elements and said banner are composed of a single sheet of material.

3. The container of claim 1, wherein said container elements and said banner are composed of separate sheets of material.

4. The container of claim 1, wherein said container elements are attached to said banner each by means of a flexible joint.

5. The container of claim 1, wherein said container elements are substantially equal in size and shape.

6. The container of claim 1, wherein said container elements further include at least one transparent window for displaying said promotional and novelty items.

7. The container of claim 1, wherein a graphic image is imprinted upon the inner surface of said banner.

8. The container of claim 1, wherein said container elements are adapted to fit adjacent to each other with an intervening gap therebetween.

9. A container for the distribution and display of promotional and novelty items, said container having an open and closed position and comprising:

at least two separate container elements adapted to receive and store said promotional and novelty items, said elements including at least one opening;

a banner having interior and exterior surfaces, wherein the length of said banner is at least as long as the combined width of said elements;

wherein said banner is connected to both of said at least two separate container elements by foldable joints such that the two container elements are permanently joined;

wherein said elements cover at least a portion of said interior surface when said container is in said closed position, and wherein said elements reveal said at least a portion of said interior surface when said container is in said open position;

wherein said container is adapted to be folded into a substantially flat profile when said container is in a partially assembled state;

wherein said banner comprises a first graphic image imprinted on said interior surface and a second graphic image imprinted on said exterior surface;

wherein said container elements and said banner are composed of a single sheet of material;

wherein said first graphic image and said second graphic image are imprinted on the same side of said single sheet of material; and wherein said banner comprises a first portion of said single sheet joined to a second portion of said single sheet such that said first portion of said single sheet forms the interior surface of said banner and said second portion of said single sheet forms the exterior surface of said banner.

10. The container of claim 9 wherein said first portion and said second portion are essentially the same shape and where said same shape is essentially rectangular.

11. The container of claim 9 where said first portion and said second portion share a common edge and where said common edge is approximately perpendicular to said foldable joints.

* * * * *